US006213345B1

(12) United States Patent
Plank

(10) Patent No.: US 6,213,345 B1
(45) Date of Patent: Apr. 10, 2001

(54) CYLINDRICAL TISSUE DISPENSER WITH INTERLEAVED TISSUES

(76) Inventor: Wendy Ann Plank, 3888 E. 600 North, Rolling Prairie, IN (US) 46371

( * ) Notice: Subject to any disclaimer, the term of this patent is extended or adjusted under 35 U.S.C. 154(b) by 0 days.

(21) Appl. No.: 09/400,152

(22) Filed: Sep. 21, 1999

Related U.S. Application Data

(60) Provisional application No. 60/101,676, filed on Sep. 24, 1998.

(51) Int. Cl.[7] ..... B65H 1/00

(52) U.S. Cl. ..... 221/46; 221/45; 221/48; 221/49; 221/61; 206/494

(58) Field of Search ..... 221/46, 47, 48, 221/49, 45, 61, 63; 428/126, 130; 206/494

(56) References Cited

U.S. PATENT DOCUMENTS

| | | | | |
|---|---|---|---|---|
| 1,475,712 | * | 11/1923 | Moore | 206/494 |
| 2,033,582 | * | 3/1936 | Materno | 221/45 |
| 3,679,094 | | 7/1972 | Nissen et al. . | |
| 3,784,056 | * | 1/1974 | Spruyt et al. | 221/63 |
| 3,881,632 | | 5/1975 | Early et al. . | |
| 4,058,235 | * | 11/1977 | Cousia | 221/61 |
| 4,171,047 | * | 10/1979 | Doyle et al. | 206/494 |
| 4,651,895 | * | 3/1987 | Niske et al. | 221/63 |
| 5,118,554 | | 6/1992 | Chan et al. . | |
| 5,123,566 | | 6/1992 | Lage et al. . | |
| 5,213,243 | | 5/1993 | Landon . | |
| 5,415,320 | * | 5/1995 | North et al. | 221/63 |
| 5,462,197 | * | 10/1995 | Pound | 221/62 |
| 5,516,000 | | 5/1996 | Freiburger et al. . | |
| 5,520,308 | | 5/1996 | Berg, Jr. et al. . | |
| 5,740,913 | | 4/1998 | McFarland . | |
| 6,092,690 | * | 7/2000 | Bitowft et al. | 206/494 |

* cited by examiner

*Primary Examiner*—H. Grant Skaggs

(57) ABSTRACT

A pop-up tissue dispenser comprising a dispensing package and tissues is disclosed. The tissue-dispensing package is cylindrically shaped with a dispensing opening through which tissues are removed individually. The tissues are disposed in the dispensing package in a specific interleaved pattern and orientation, permitting the convenience of pop-up tissue access from the cylindrically shaped dispensing package. The dispensing package may be disposable or refillable, and may also be provided with an attachment means to further facilitate tissue removal.

16 Claims, 4 Drawing Sheets

CYLINDRICAL TISSUE DISPENSER WITH INTERLEAVED TISSUES

This application claims benefit of provisional application Ser. No. 60/101,676, filed Sep. 24, 1998.

BACKGROUND OF THE INVENTION

The present invention relates to pop-up tissue dispensers. Specifically, the invention described herein pertains to the folding configuration of interleaved tissues and the cylindrical dispenser therefor.

Tissue dispensers are designed to dispense individual tissues or similarly folded sheet product. Typically, the dispenser is comprised of a dispensing package and tissues in combination. The package contains an opening through which a single tissue is accessible and easily releasable from the rest of the tissues within the package. The pop-up style tissue dispenser provides a practical way to access individual tissues with minimal effort. The dispenser is generally parallelepiped in shape with overall dimensions that allow the user to place the dispenser anywhere accessibility to individual tissues is desirable.

These pop-up tissue dispensers are not always practical. In particular, the overall dimensions of the dispenser package can be limiting at times when the user wants to access a tissue, but the dispenser can not be conveniently located within reach. This problem occurs often when the user is in any location that does not have sufficient space for the dispenser to be placed.

Small packages of tissues are a useful alternative to the usual pop-up dispenser, but these packages usually contain tissues that are difficult to remove singly and equally difficult to unfold. The tissues may be smaller in overall size and are often of lesser quality than a typical full-size tissue. Furthermore, one has to carry the package on their person at all times to ensure convenient accessibility whenever a tissue is needed. These packages can be designed as a pop-up style dispenser, but the tissue must be unfolded to its full size prior to use. Although these small packages can be used when use of a larger box of tissues is not practical, many other inconveniences must be tolerated.

Driving an automobile poses additional problems. A typical box of full-size tissues may be out of reach if the box has been placed on the floor or in the back seat area. Small packages of tissues can also be inaccessible or difficult to find while driving. To help alleviate this particular problem, some automobiles have a specific location within the console, door or ceiling that is designed to accommodate a pre-packaged box of tissues. This enables the driver to access the tissues conveniently as needed. But not all automobiles are designed with such a tissue box holder.

These alternatives to a pop-up style dispenser do not provide adequate convenience in these situations, especially while driving. And because a person can spend a large amount of time travelling in automobiles, there is a need for a new pop-up style tissue dispenser that is both accessible and convenient to use while driving and at times when a larger box of tissues is not practical.

BRIEF SUMMARY OF THE INVENTION

The present invention described herein addresses the need to create a pop-up style tissue dispenser that allows for improved accessibility over currently available dispensers while maintaining the overall convenience of a pop-up style dispenser.

The invention comprises a cylindrical dispensing package and tissues in combination. The dispensing package is cylindrical in shape with a dispensing opening at one end. A plurality of tissues is sequentially disposed in the dispensing package in a specific interleaved pattern. The invention is designed to dispense facial tissues as well as any other types of folded sheet product, such as dry or moistened wipes, fabric softener sheets, or the like. Thus, the term "tissue" is used herein to describe any type of individual sheet product.

Each tissue is first pre-folded to reduce one dimension of the tissue to approximately one half its original length. This dimension shall be referred to as the width. The pre-folded tissue has lead and trailing edges that are parallel to the width of the tissue, the distance between which defines the length of the tissue. Two interfolds are made which are parallel to the lead and trailing edges. The first interfold is located approximately one-eighth of the tissue length from the lead edge and the second interfold is located approximately one half of the remaining length from the first interfold to the trailing edge. These interfolds impart a Z-like configuration to the tissue. Successive tissues are interleaved with the trailing edge of the accessible tissue, or leading tissue, located below the leading edge of the following tissue, creating an area of overlap between the tissues. The entire clip of interleaved tissues is oriented with the lead and trailing edges and interfolded edges at the top and bottom of the cylindrical dispensing package. Additionally, the clip of tissues is rolled about the longitudinal centerline of the dispensing package so that the longitudinal edges of the tissues are within close proximity of each other. This tissue configuration and orientation allow individual tissues to be dispensed vertically through the dispensing opening. The dispensing opening effectively causes the separation of adjacent tissues by constricting the tissue following the leading tissue near the first interfold. The leading tissue pulls the leading edge of the following tissue through the dispensing opening as it is removed from the dispenser by means of friction or other static forces. The following tissue becomes accessible upon removal of the leading tissue.

DETAILED DESCRIPTION OF THE INVENTION

Figure 1:
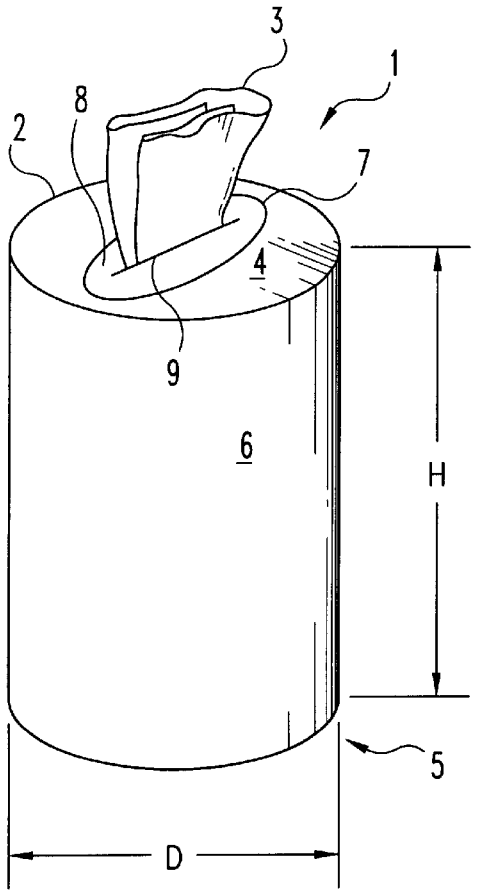
FIG. 1 is a perspective view of the dispenser and tissues illustrating the location of the dispensing opening and a partially removed leading tissue.

Referring to FIG. 1, the pop-up tissue dispenser 1 according to the present invention comprises a dispensing package 2 and a clip of pre-folded interfolded tissues 3 in combination. The dispensing package 2 is generally cylindrically shaped, having a circular top and bottom surfaces 4 and 5, and a single cylindrical shaped sidewall 6 that extends between the top and bottom surfaces. A dispensing opening 7 is located at the top surface 4 with a protective plastic film overlay 8 and dispensing slit 9 within the film. The height of the dispensing package 2 is designated as dimension 'H' and the diameter of the top 4 and bottom 5 surfaces is designated as dimension 'D'.

The dispensing package 2 can be constructed using any suitable means common in the packaging industry from any lightweight material such as paperboard, plastic, or the like. Dimensions D and H of the invention are intended to be variable. The preferred embodiment has a diameter D of approximately 7 cm and a height H of approximately 10 cm. The dispensing package 2 would be made preferably of a paperboard so that the dispenser may be disposable (not refillable). Additionally, the dispensing package 2 can be made of aluminum sheeting similar to that used to manufacture soda-pop cans and the like. This option is more economically feasible because aluminum is recyclable. This option may also be appealing because consumer acceptance may be improved if the dispensing package is constructed to be similar to packages already being used.

In addition, any of a variety of surface attachment means can be used to attach the tissue dispenser to a surface to facilitate tissue removal. Examples of such means include hook-and-loop fasteners, pressure sensitive tapes, suction cups and clips, etc. A pressure sensitive tape attached to the bottom surface or along a portion of the dispenser sidewall perimeter would improve the overall convenience afforded by this invention.

Figure 2:
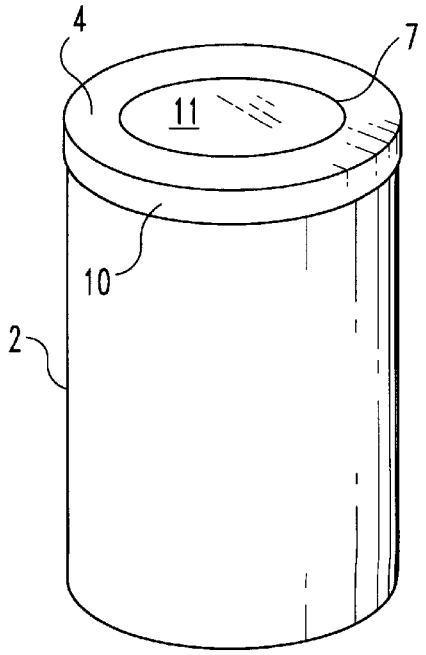
FIG. 2 is a perspective view of an alternative refillable dispensing package which may be refilled with additional clips of pre-packaged tissues, illustrating the location of the dispenser opening within the removable lid.

FIG. 2 show a perspective view of a dispensing package 2 which incorporates a flexible snap-on lid 10 such as found in the prior art that includes the top surface 4. A removable panel section 11 is delineated by the outline of the dispensing opening 7, the panel section 11 being releasably attached to the top surface 4 by scoring or perforating the top surface materials. The removable panel section 11 is to be removed by the consumer prior to the first use. This alternate dispensing package would allow the dispenser to be refillable with additional clips of tissues. In this embodiment, the dispensing package would be made preferably of a lightweight, rigid plastic material. The plastic film overlay would not be necessary in this embodiment. Additional clips of tissues would be available as single pre-packaged units, preferably wrapped in a thin plastic film or shrink-wrap to maintain the proper tissue interleaving pattern and orientation. The surrounding plastic film would have an opening slit located at the top of the clip which, upon insertion into the refillable plastic dispensing package, would function to separate individual tissues as each is removed from the dispenser.

Figure 3:
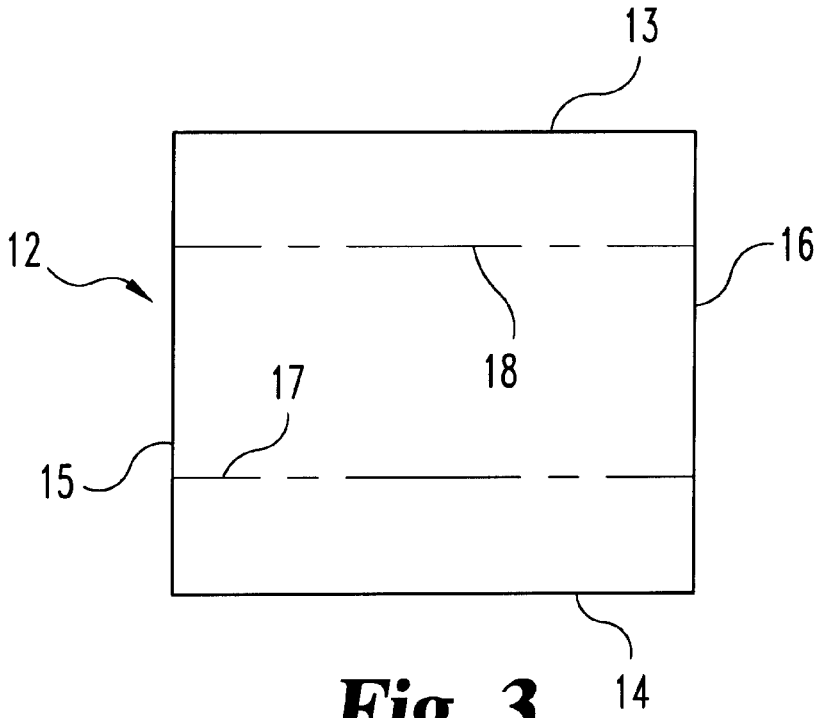
FIG. 3 is a plan view of a typical full-size individual, rectangular tissue in its unfolded state.

FIG. 3 shows a schematic of a typical individual rectangular shaped tissue 12 in its fully unfolded state. The tissue has two side edges 13 and 14 and two end edges 15 and 16. Dashed lines 17 and 18 represent two fold lines at which the tissue is folded to reduce one dimension of the tissue 12 to approximately one half its original length. This is the preferred method of pre-folding. Alternatively, the tissue 12 may be folded at the centerline as a V-fold (not shown).

Figure 4:
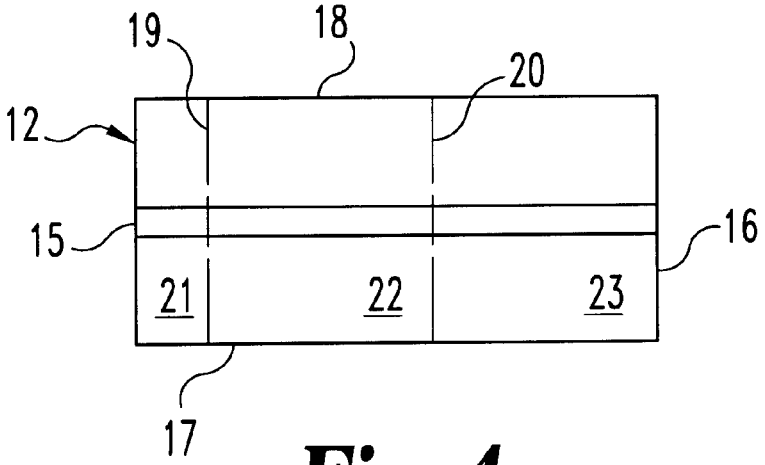
FIG. 4 is a plan view of a single pre-folded tissue illustrating the general location of the interfolds.

FIG. 4 shows a schematic illustration of a single pre-folded tissue 12. The pre-folding indicated in FIG. 2 creates side edges 17 and 18, oriented along the longitudinal dimension of the tissue. Two interfold fold lines 19 and 20 are shown as dashed lines, oriented along the transverse dimension of the tissue. Interfold location 19 is a distance approximately one-eighth to one-third the length of the tissue 12, measured from the lead edge 15. The location of this fold 19 may vary depending on the length of tissue that is desired to remain outside of the dispenser prior to its removal from the dispenser. This leading edge region is denoted by the numeral 21 in FIG. 2. The length of this 'popped-up' region 21 of the tissue will be approximately equivalent to the length between the leading edge 15 and the interfold 19. Interfold location 20 is a distance approximately one-third to one-half the length of the tissue 12, measured from the trailing end edge 16. This fold location 20 may also vary depending on the location of fold 19. In general, this fold is made to substantially reduce the overall length of the tissue, creating the middle and trailing end regions 22 and 23, which are approximately the same sizes. The length of regions 22 and 23 are necessarily less than the height of the dispenser (denoted by the H in FIG. 1).

Figure 5:
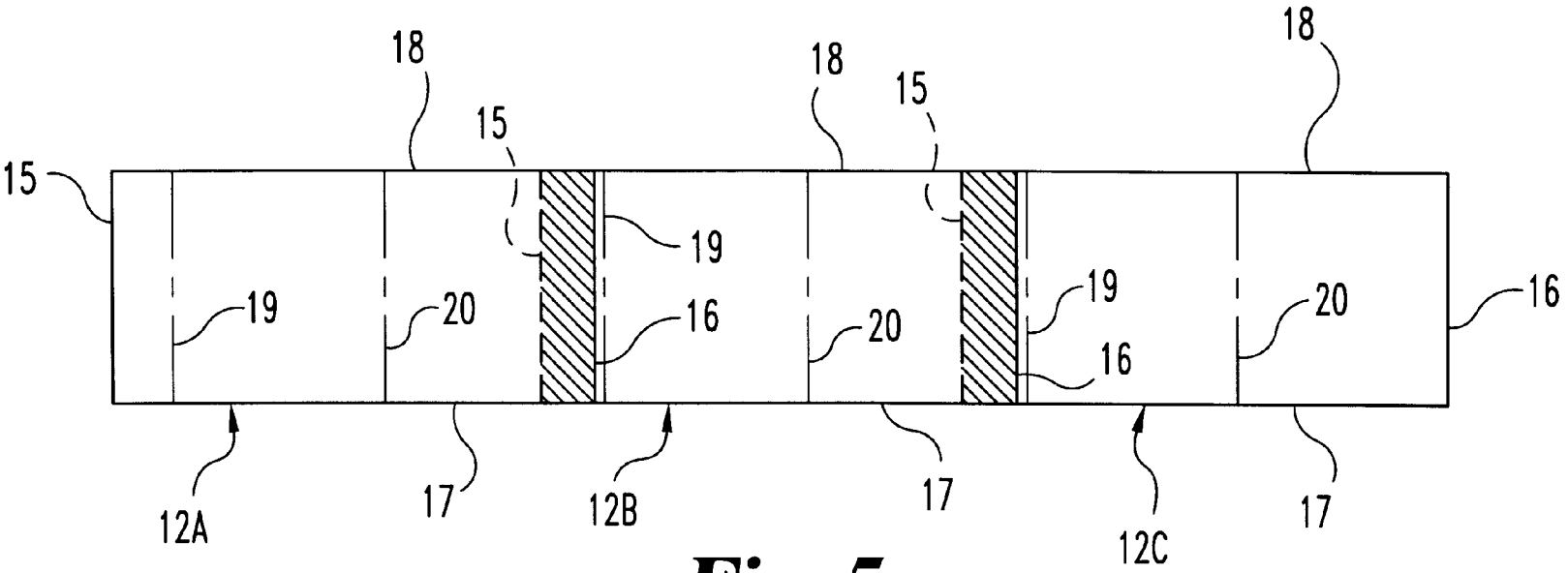
FIG. 5 is a plan view of three individual pre-folded tissues illustrating the locations of the interfolds relative to the lead and trailing edges of adjacent tissues.

FIG. 5 depicts three individual pre-folded tissues 12A, 12B and 12C in the pre-folded state. This figure illustrates the relative locations of adjacent tissue edges 15 and 16 and interfold fold locations 19 and 20. An overlapping region 24 (denoted by hatched lines) results when trailing edge 16 of a first tissue 12A overlaps the leading edge 15 of second tissue 12B. Trailing end edge 16 of a first tissue 12A is substantially parallel and generally in registry with interfold location 19 of the second tissue 12B. The amount of overlap between adjacent tissues 12A and 12B may vary so that the leading edge region 21 of the second tissue 12B is larger than the overlapping region 24 formed between the adjacent tissues 12A and 12B. It is preferred that the leading edge region 21 and the overlap region 24 be approximately equivalent in area, although the overlap region 24 may be smaller than the leading edge region 21 without compromising the utility of this invention.

Figure 6:
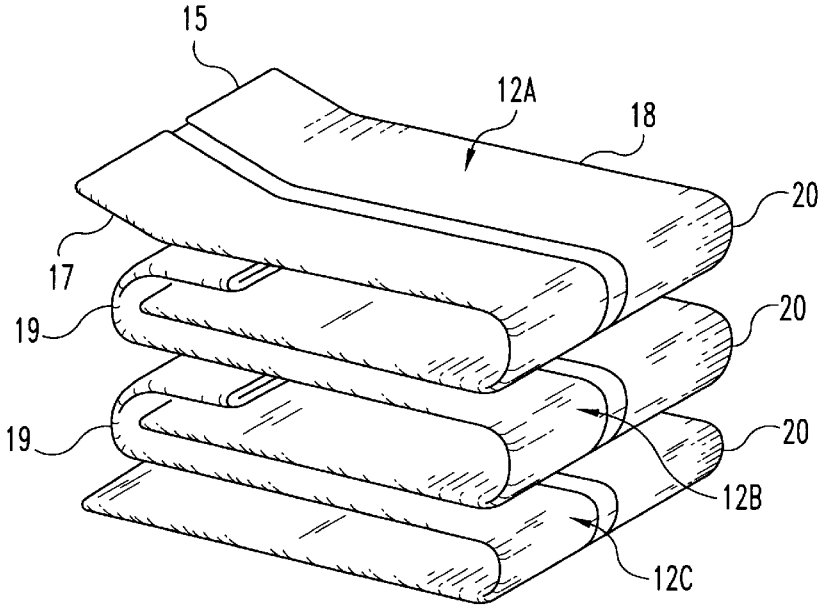
FIG. 6 is a perspective view of the three pre-folded tissues that have been interfolded.

FIG. 6 depicts a perspective view of three interfolded tissues 12A, 12B and 12C. Overlapping region 24 clearly shows how the trailing edge region 23 of the leading tissue 12A lies below the leading edge region 21 of the second tissue 12B.

Figure 7:
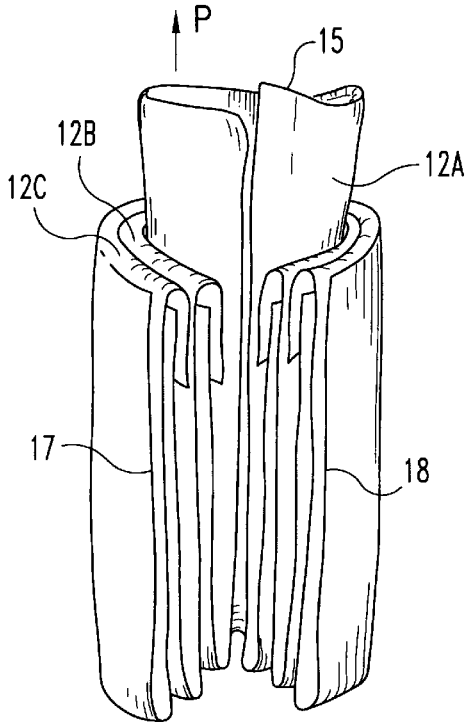
FIG. 7 is a perspective view of several interfolded tissues rolled about a longitudinal centerline illustrating the final orientation of the clip of tissues prior to being placed within the dispensing package, the lead tissue being located centrally.

The final dimensions and orientation of three tissues prior to being placed within the dispensing package 2 are shown in a perspective view in FIG. 7. Side edges 17 and 18 of the tissues 12A, 12B and 12C have been rolled about the longitudinal centerline of the cylindrical package, remaining substantially parallel. Interfold 19 of each tissue has a circular shape within the transverse plane. Arrow P indicates the direction of the pulling force as it is applied to the lead tissue 12A. As the lead tissue 12A is removed, the trailing edge region 23 of the lead tissue 12A acts to pull and unfold the leading edge region 21 of the adjacent tissue 12B. Upon removal of the lead tissue 12A, the leading edge 15 of the adjacent tissue 12B is accessible for subsequent removal.

I claim:

1. A pop-up tissue dispenser, comprising:

a cylindrically shaped dispensing package having a uniformly circular sidewall surface connecting the bottom and top surfaces, the top surface having a package opening therein; and a clip of pre-folded interleaved tissues, each tissue comprising (1) a sheet having two substantially parallel side edges oriented parallel to the longitudinal dimension and two substantially parallel end edges oriented parallel to the transverse dimension;

(2) two pre-fold folds oriented in the longitudinal direction of the sheet approximately one-quarter sheet width and three-quarters sheet width from one of the side edges, thereby reducing the overall sheet width to approximately one-half the original sheet width;

(3) one interfold oriented transversely and substantially parallel to the end edges, located approximately one-eighth sheet length from one edge, thereby creating a leading end region;

(4) a second interfold oriented transversely and substantially parallel to the end edges, located approximately half-way between the first interfold and the trailing end edge, thereby creating a middle region and trailing edge region;

(5) a generally circular configuration which is oriented about the longitudinal centerline, the side edges of the sheet remaining substantially parallel to each other.

2. The pop-up tissue dispenser of claim 1, further comprising a thin, transparent plastic overlaying the dispensing package opening and defining therein a dispensing slit.

3. The pop-up tissue dispenser of claim 1, further comprising a surface attachment means.

4. The pop-up tissue dispenser of claim 3, wherein the surface attachment means is a pressure sensitive tape.

5. The pop-up tissue dispenser of claim 3, wherein the surface attachment means is a hook-and-loop fastener.

6. The pop-up tissue dispenser of claim 1, wherein the area of the dispensing package opening is from about 8 to about 16 square centimeters.

7. The pop-up tissue dispenser of claim 1, wherein the diameter of the dispensing package is from about 5 to about 8 centimeters.

8. The pop-up tissue dispenser of claim 1, wherein the height of the dispensing package is from about 8 to about 10 centimeters.

9. A pop-up tissue dispenser, comprising:

a cylindrically shaped dispensing package having a uniformly circular sidewall surface connecting the bottom and top surfaces, the top surface being a releasable lid with a package opening defined therein; and a clip of pre-folded interleaved tissues, each tissue comprising (1) a sheet having two substantially parallel side edges oriented parallel to the longitudinal dimension and two substantially parallel end edges oriented parallel to the transverse dimension;

(2) two pre-fold folds oriented in the longitudinal direction of the sheet approximately one-quarter sheet width and three-quarters sheet width from one of the side edges, thereby reducing the overall sheet width to approximately one-half the original sheet width;

(3) one interfold oriented transversely and substantially parallel to the end edges, located approximately one-eighth sheet length from one edge, thereby creating a leading end region;

(4) a second interfold oriented transversely and substantially parallel to the end edges, located approximately half-way between the first interfold and the trailing end edge, thereby creating a middle region and trailing edge region;

(5) a generally circular configuration which is oriented about the longitudinal centerline, the side edges of the sheet remaining substantially parallel to each other.

10. The pop-up tissue dispenser of claim 9, further comprising a surface attachment means.

11. The pop-up tissue dispenser of claim 10, wherein the surface attachment means is a pressure sensitive tape.

12. The pop-up tissue dispenser of claim 10, wherein the surface attachment means is a hook-and-loop fastener.

13. The pop-up tissue dispenser of claim 9, wherein the area of the dispensing package opening is from about 8 to about 16 square centimeters.

14. The pop-up tissue dispenser of claim 9, wherein the diameter of the dispensing package is from about 5 to about 8 centimeters.

15. The pop-up tissue dispenser of claim 9, wherein the height of the dispensing package is from about 8 to about 10 centimeters.

16. The pop-up tissue dispenser of claim 9, further comprising a clip of tissues that is enclosed by a thin, transparent plastic film with a dispensing slit located along the diameter of the top end surface of the film.

* * * * *